United States Patent [19]

Lipinski

[11] 4,217,216

[45] Aug. 12, 1980

[54] CORROSION INHIBITING COMPOSITIONS

[75] Inventor: Richard J. Lipinski, Aurora, Ohio

[73] Assignee: The Mogul Corporation, Chagrin Falls, Ohio

[21] Appl. No.: 2,249

[22] Filed: Jan. 10, 1979

Related U.S. Application Data

[63] Continuation-in-part of Ser. No. 783,646, Apr. 1, 1977, Pat. No. 4,138,353, and Ser. No. 967,584, Dec. 8, 1978.

[51] Int. Cl.[2] ..... B01D 5/00

[52] U.S. Cl. ..... 210/58; 252/181; 252/387; 252/389 A; 210/59; 106/14.12; 422/12

[58] Field of Search ..... 252/389 A, 181, 87, 252/387, 389 R; 210/59, 60, 58; 422/12; 106/14.12

[56] References Cited

U.S. PATENT DOCUMENTS

| | | | |
|---|---|---|---|
| 3,110,684 | 10/1963 | Miller | 252/389 A |
| 3,214,454 | 10/1965 | Blaser et al. | 260/429.9 |
| 3,336,221 | 8/1967 | Ralston | 210/58 |
| 3,639,645 | 2/1972 | Miller | 252/180 |
| 3,699,048 | 10/1972 | Krueger | 252/180 |
| 3,723,347 | 3/1973 | Mitchell | 252/389 A |
| 3,784,469 | 1/1974 | Krueger et al. | 210/58 |
| 3,806,459 | 4/1974 | Petrey | 252/82 |
| 3,891,568 | 6/1975 | Nishio | 252/389 A |
| 3,960,576 | 1/1976 | Carter et al. | 252/389 A |
| 3,992,318 | 11/1976 | Gaupp | 252/389 A |

*Primary Examiner*—Benjamin R. Padgett
*Assistant Examiner*—J. L. Barr
*Attorney, Agent, or Firm*—Fay & Sharpe

[57] ABSTRACT

This invention relates to a corrosion inhibiting composition and to the process for inhibiting corrosion and the deposition of mineral scale on metal in aqueous systems. The process comprises adding to water a novel composition containing an azole, molybdates and effective amounts of at least one aminomethylene phosphonic acid and the derivatives thereof.

30 Claims, No Drawings

CORROSION INHIBITING COMPOSITIONS

This application is a continuation-in-part of U.S. Patent applications Ser. No. 783,646, filed Apr. 1, 1977, now U.S. Pat. No. 4,138,353, and Ser. No. 967,584, filed Dec. 8, 1978.

This invention is directed to a corrosion inhibiting composition and to a process for inhibiting corrosion and the deposition of mineral scale on metal in various aqueous systems and, more particularly, to a process for protecting metal in the presence of water by adding to the water effective amounts of at least one aminomethylene phosphonic acid and various derivatives thereof in combination with a molybdate, e.g. an alkali metal molybdate. In addition, other corrosion inhibiting compounds such as the triazoles and various inorganic metal compounds such as the inorganic metal salts and oxides may be used in combination with the aminomethylene phosphonic acid and the molybdate.

BACKGROUND

The use of inorganic corrosion inhibitors, e.g. metal oxides alone and/or in combination with organic inhibitors including phosphonic acids have been used in various aqueous systems. It has been found, in accordance with this invention, the hexamethylenediamine tetra(methylene phosphonic acid), the dimer of hexamethylenediamine tetra(methylene phosphonic acid) and the various derivatives thereof when used in combination with a certan amount of molybdate have improved corrosion inhibition and prevent the deposition of mineral scale.

In general, corrosion is defined as a destructive attack on metal involving an electrochemical or chemical reaction of the metal with its environment. More specifically, an electrochemical attack on a metal surface is the wearing away and undercutting of the metal, which is accelerated after the protective coating, e.g. the oxide film is removed by the corrosive medium. Other types of corrosion include cavitation and erosion where, in addition to an electrochemical reaction, the condition of the aqueous system is such that the continuous flow causes cavities where high pressure areas develop causing pressure and shock resulting in a pitted metal surface. This type of corrosion generally is found in water pumps, propellers, turbine blades, etc. Further, erosion of the metal surface occurs if the medium contains suspended solids which impinge on the surface of the metal as the fluid is transported thereby removing any protective film and exposing the metal to corrosion.

Presently, because of the environmental problems, there is a need to use many of the known corrosion inhibiting compositions at lower concentrations. Often these compositions contain an agent to control scale formation which, however, has a tendency to increase the rate of corrosion. Therefore, it is becoming necessary to use stronger corrosion inhibitors at higher concentrations in order to obtain satisfactory results. The use of some of the inhibitors, e.g. the chromates, etc. at the higher concentrations is unsatisfactory due to the environmental restrictions. It has been found, however, that by utilizing an aminomethylene phosphonic acid or its derivative, i.e. hexamethylenediamine tetra(methylene phosphonic acid) with a molybdate, lower concentrations of these undesirable inhibitors can be used in combination therewith and in many instances even a weaker inhibitor will provide satisfactory results. The compositions of this invention not only eliminate the need for using toxic materials at the higher concentrations, but also provides a corrosion inhibitor effective in a number of different systems.

SUMMARY

To avoid these and related problems, it has been found that hexamethylenediamine tetra(methylene phosphonic acid) and the dimer thereof including the various derivatives of the acid and its dimer when used in effective amounts are capable of protecting metals and alloys, e.g. copper, brass, steel, etc. The corrosion inhibiting composition may be used in various aqueous systems including, for example, air conditioners, steam generating plants, refrigeration systems, heat-exchange pipes and related equipment.

Accordingly, it is an object of this invention to provide a composition for inhibiting corrosion and to minimize the deposition of mineral scale on metal coming in contact with water. It is another object of this invention to provide a process for inhibiting corrosion and mineral deposition on metal. It is a further object to provide a process for inhibiting the corrosion and tarnishing of metals and particularly metal containing copper and iron by utilizing small, but effective amounts of an aminomethylene phosphonic acid and its derivatives in combination with a molybdate, e.g. sodium molybdate.

These and other objects will become apparent from a further and more detailed description.

DETAILED DESCRIPTION

Specifically, this invention relates to a composition and to a method of using said composition for inhibiting the corrosion of metal and to prevent the deposition of mineral scale by adding to the water, parts based on a million parts by weight of the water, from about:

(a) 0 to 50 parts by weight of an azole such as benzotriazole, tolyltriazole and various mixtures thereof, (b) 1.5 to 100 parts by weight of a molybdate including the alkali metal molybdates, ammonium molybdate and various mixtures thereof, and (c) 2 to 100 parts by weight of at least one aminomethylene phosphonic acid or a derivative thereof selected from the group consisting of hexamethylenediamine tetra(methylene phosphonic acid), the dimer of hexamethylenediamine tetra(methylene phosphonic acid) and the various derivatives of the acid and its dimer such as the alkali metal salts or esters, etc. of the phosphonic acid.

The derivatives of the hexamethylenediamine tetra (methylene phosphonic acid) and its dimer may be used alone or in combination with other inhibitors provided the derivatives, e.g. the salt or esters, etc. are substantially soluble in water. For purposes of this invention, the term hexamethylenediamine tetra(methylene phosphonic acid), its dimer and the various derivatives of the acid and its dimer are referred to herein as an aminomethylene phosphonic acid. The aminomethylene phosphonic acid, etc. are used in effective amounts, i.e. amounts sufficient to inhibit corrosion which generally ranges from about 2 to 100 parts by weight per million parts by weight of water and preferably in amounts ranging from 2 to 50 parts or 4.0 to 50 parts by weight per million parts by weight of water.

In addition to aminomethylene phosphonic acid and its derivatives, at least one molybdate and preferably an alkali metal molybdate must be used in combination therewith in critical amounts ranging from about 1.5 to 100 parts by weight per million parts by weight of water and preferably in amounts ranging from 3.0 to 30 parts by weight per million parts by weight of water.

The azole and particularly benzotriazole and tolyltriazoles are added to aqueous systems particularly to protect copper-containing metals from corrosion. The azoles are used in amounts ranging from 0 to 50 parts by weight and preferably in amounts ranging from 0.1 to 30 parts by weight per million parts by weight of water. Other known inorganic and/or organic corrosion inhibitors may be utilized in small, but effective, amounts in combination with the corrosion inhibiting composition of this invention. The inorganic compounds, known for inhibiting corrosion, which may be used in combination with the composition of this invention include the inorganic metal oxides and salts. These inorganic compounds together with the known polymeric dispersants may be used in small, but effective, amounts in aqueous systems.

The inorganic compounds, known to function as corrosion inhibitors in water, are used in amounts ranging up to about 50 parts by weight per million and, more likely, in amounts ranging from 0.1 to 30 parts by weight per million and include such compounds as the metal oxides and salts, e.g. the nitrates, nitrites, silicates, carbonates, e.g. sodium silicate, sodium nitrite, sodium nitrate, sodium carbonate, potassium nitrite, ammonium silicate and the metal oxides such as zinc oxide, calcium oxide and various combinations in any relative proportion.

In addition to corrosion problems, a cooling system, for example, may have other difficulty depending on the impurities in the water. If water is vaporized in the system, scale formation may be a problem. This can be avoided, either by softening the water, e.g. using an ion-exchange treatment or by complexing the scale by adding to the water at least one polymeric dispersing agent. Polymeric dispersing agents are known materials which can be used for the removal, settling or flock formation of suspended matter found in the water and particularly water which has not been previously treated. These polymeric dispersing agents include hydrolized polyacrylonitriles, the lignosulfonates, and particularly the acrylic polymers, e.g. the homo or copolymers derived from monomers such as acrylic acid, methacrylic acid, acrylamide, etc.

More specifically, these polymeric dispersants are well known and may be used in combination with the corrosion inhibiting composition of this invention. The preferred polymeric dispersing agents include the sulfonated polystyrenes, the polymers of ethylene oxide, the homo and copolymers of various acrylic monomers, e.g. acrylic acid and acrylamide and various mixtures thereof. These polymers have a functional group —C=C—R wherein R is selected from the group consisting of nitrile, amide or carboxyl radical wherein the carboxyl radical is either an acid, metal salt or ester derived from a lower alkyl radical. Some of the most preferred polymeric dispersing agents, to be used with the corrosion inhibiting compositions of this invention, include not only the homopolymers, but also the copolymers of acrylic acid, acrylamide and/or methacrylic acid and methacrylamide. The polymers are used in various combinations, e.g. physical mixtures of sulfonated polystyrene and the acrylic-type polymers, i.e. copolymers of acrylic acid and acrylamide or homopolymers of acrylic acid or homopolymers of acrylamide.

Other monomers which may be used for the preparation of the polymeric dispersing agents include polymers derived from a variety of acids, including maleic acid, itaconic acid, itaconitic acid, Nadic anhydride, vinyl acetate, etc. All of these water-soluble polymers may be used as dispersants in combination with the corrosion inhibitor composition in small, but effective amounts, e.g. as low as 0.1 parts per million and upward of up to 30 parts per million or from 0.1 to 10 ppm depending on the condition of the water and the type of water being treated.

The data in Table I shows that the combination of hexamethylenediamine tetra(methylene phosphonic acid), at increasing concentrations of the metal molybdate up to about a ratio of 1 to 1, increases the percent of corrosion inhibition, i.e. from about 0.1 to 1.0 parts by weight of the molybdate to 1.0 part by weight of the aminomethylene phosphonic acid or its derivative.

EXAMPLE A

Cooling Water Test Formulation

| | Parts by Weight million parts of $H_2O$ |
|---|---|
| Polyacrylic Acid (2000 Mol Weight) | 8.0 |
| Citric Acid | 16.0 |
| Hexamethylenediamine tetra (methylene phosphonic acid) | 6.0 |
| Benzotriazole | 1.0 |
| H.M.W. Sulfonated Polystyrene | 0.5 |
| Sod. Molybdate Dihydrate | Variable |

TABLE I

| Sodium Molybdate Dihydrate (Conc. ppm) | Corrosion Potentials (MVS) Initial - Final | Percent Corrosion Inhibition Filtered Chagrin Plant Water |
|---|---|---|
| 0.0 | 360–420 | 83.3 |
| 2.0 | 380–390 | 85.0 |
| 4.0 | 370–360 | 90.8 |
| 6.0 | 370–360 | 90.8 |
| 8.0 | 370–320 | 91.7 |
| 10.0 | 400–320 | 91.7 |

The corrosion inhibiting composition of Example B illustrates that the combination of a metal molybdate with the hexamethylenediamine tetra(methylene phosphonic acid) improved the inhibition as the concentration of the phosphonic acid increased from 2 to 8 parts per million. Where the molybdate was omitted, the corrosion inhibition decreased as illustrated by the data in Table II.

EXAMPLE B

| | Parts by Weight (ppm) million parts by $H_2O$ |
|---|---|
| Sodium Molybdate | 20 |
| Benzotriazole | 1 |
| H.M.W. Sulfonated Polystyrene | 0.5 |
| Hexamethylenediamine tetra (methylene phosphonic acid) | Variable |

TABLE II

| Hexamethylenediamine Tetra (Methylene Phosphonic Acid) (Conc. ppm) | Corrosion Potentials Initial - Final | Percent Corrosion Inhibition Filtered Chagrin Plant Water |
|---|---|---|
| 0 | 460–610 | 33.3 |
| 2 | 380–390 | 91.6 |
| 4 | 380–390 | 91.6 |

TABLE II-continued

| Hexamethylenediamine Tetra (Methylene Phosphonic Acid) (Conc. ppm) | Corrosion Potentials Initial - Final | Percent Corrosion Inhibition Filtered Chagrin Plant Water |
|---|---|---|
| 6 | 360–328 | 95.0 |
| 8 | 370–320 | 96.7 |
| 12 (no molybdate) | 460–500 | 83.3 |

It was discovered further that hexamethylenediamine tetra(methylene phosphonic acid) in combination with the molybdate, for example, gave a synergistic result as illustrated by the data in Table III. Where the ratio of the molybdate to the phosphonate is less than 1 to 1, the percent corrosion inhibition is at the optimum. This was found to be particularly true where the hexamethylenediamine tetra(methylene phosphonic acid) was used as compared to the lower molecular weight phosphonates as shown in Table IV.

TABLE III

| Compositions | Conc. in ppm | Percent Corrosion Inhibitor 47 Hours Filtered Chagrin Plant Water | 68 Hours Open Cell Water |
|---|---|---|---|
| (1) Sodium Molybdate Dihydrate + Hexamethylenediamine tetra (methylene phosphonic acid) | 13.13/15 | 94 | 85.5 |
| (2) Sodium Molybdate Dihydrate | 13.13 | 16.7 | 15.4 |
| (3) Hexamethylenediamine tetra (methylene phosphonic acid) | 15.0 | 71.6 | 59.0 |

TABLE IV

| STANDARD COMPOSITION | MOLYBDATE TO PHOSPHONATE RATIO (ppm) | 19 Hrs. % CORROSION INHIBITION OCW Co Phos.[1] | $C_2$ Phos.[2] | $C_6$ Phos.[3] |
|---|---|---|---|---|
| I | 5/6 | 56.7 | 73.3 | 85.0 |
| II | 10/1 | 33.3 | 46.7 | 56.7 |
| III | 5/1 | 33.3 | 66.7 | 70.0 |

[1]Co Phos. - Aminotri (Methylene Phosphonic Acid)
[2]$C_2$ Phos. - Ethylenediamine Tetra (Methylene Phosphonic Acid)
[3]$C_6$ Phos. - Hexamethylenediamine Tetra (Methylene Phosphonic Acid)

The data in Table III shows that the percent of corrosion inhibition of the hexamethylenediamine tetra(methylene phosphonic acid) alone was 71.6 and 59%, and the percent of corrosion inhibition of the molybdate alone was 16.7 and 15.4%, but the combination of the metal molybdate and the hexamethylenediamine tetra(methylene phosphonic acid) at a ratio of less than 1 to 1 improved the corrosion inhibition to 85.5% after 68 hours and to 94% after 47 hours.

The compositions were tested for corrosion inhibition by using the three electrode electrochemical test method. The procedure employed is as follows: Corrosion potentials of 1010 carbon steel test coupons are monitored against a standard calomel reference electrode in a specific water type at 100±2° F. and a pH range of 7.5 to 8.0. Corrosion currents corresponding to these potentials are measured against a nichrome wire getter electrode with a zero resistance ammeter at polarization potentials of less than 20 millivolts. Using Faraday's Law, these corrosion currents are converted to total weight loss values. Percent corrosion inhibition levels as shown in the Tables are then calculated using the following expression.

$$\% \text{ Corr. Inhib.} = \frac{\text{Wgt. Loss } (-\text{ inhib.}) - \text{Wgt. Loss } (+\text{ inhib.}) \times 100}{\text{Wgt. loss } (-\text{ inhib.})}$$

The filtered test water employed comprises:

| | |
|---|---|
| TH ($CaCO_3$) | 162 |
| Ca ($CaCO_3$) | 108 |
| Mg ($CaCO_3$) | 54 |
| Cl ($Cl^-$) | 74 |
| PHT, Alk ($CaCO_3$) | 0 |
| M.O. Alk ($CaCO_3$) | 218 |
| pH | 7.7 |
| Spec. Conduc. | 680 |

Open cell water is distilled water containing 50 ppm of active chloride ion.

The compositions of this invention are non-toxic and prevent corrosion of metals in contact with various aqueous systems. Therefore, the compositions can be substituted for the more toxic materials such as the chromates where the toxicity makes them undesirable particularly when disposal of these inhibitors raises a serious pollution problem.

The compositions are particularly suitable for reducing the corrosion of iron, copper, aluminum, zinc and various alloys of these metals, e.g. steel and other ferrous alloys, such as brass and the like which are generally used in aqueous systems. The hexamethylenediamine tetra(methylene phosphonic acid), the dimer and its derivatives include the water-soluble salts such as the alkali and alkaline earth metal salts, the amine and lower alkanol amine salts, etc. In addition, the lower molecular weight esters of the phosphonic acid can be employed. These esters are derived from the lower molecular weight aliphatic alcohols having 1 to 4 carbon atoms. Combinations of the acids, salts, esters, etc. can be employed provided they are substantially water-soluble.

The organic inhibitors include, for example, the azoles and more particularly the triazoles. The azoles include the pyrazoles, imidazoles, oxazoles, thiazoles and combinations thereof. The triazoles include the water-soluble 1,2,3-triazoles or substituted 1,2,3-triazoles including benzotriazole, tolyltriazole, 4-phenyl-1,2,3-triazole 1,2-naphthotriazole, 4-nitrobenzotriazole, etc. The pyrazoles include any water-soluble compound such as 3,5-dimethyl pyrazole, 6-nitroindazole, 4-benzyl pyrazole and the like. The imidazoles include the water-soluble compounds such as benzimidazole, 5-methyl benzimidazole, 2-phenyl imidazole, 4-methyl imidazole and the like. The oxazoles include any water-soluble compound such as 2-mercaptoxazole, 2-mercaptobenzoxazole, etc. The thiazoles include 2-mercaptothiazole, 2-mercaptobenzothiazole, benzothiazole, etc.

While this invention has been described by a number of specific embodiments, it is obvious there are variations and modifications which can be made without departing from the spirit and scope of the invention as set forth in the appended claims.

I claim:

1. A composition for inhibiting mineral scale and corrosion of metals in the presence of water which comprises, parts based on a million parts by weight of water, from about:
   (a) 0 to 50 parts by weight of an azole,
   (b) 1.5 to 100 parts by weight of a molybdate, and
   (c) 2.0 to 100 parts by weight of at least one aminomethylene phosphonic acid or a derivative thereof selected from the group consisting of hexamethylenediamine tetra(methylene phosphonic acid) and the dimer of hexamethylenediamine tetra(methylene phosphonic acid).

2. The composition of claim 1 further characterized in that the molybdate is present in an amount ranging from about 3.0 to 30 parts by weight.

3. The composition of claim 2 further characterized in that the aminomethylene phosphonic acid and its derivatives are present in an amount ranging from about 4.0 to 50 parts by weight.

4. The composition of claim 3 further characterized in that the molybdate is an alkali metal molybdate.

5. The composition of claim 1 further characterized in that the molybdate and the aminomethylene phosphonic acid or its derivatives are present at ratios of about 0.1 to 1.0 part by weight of the molybdate to 1.0 part by weight of the aminomethylene phosphonic acid or its derivatives.

6. The composition of claim 5 further characterized in that the molybdate and the aminomethylene phosphonic acid or its derivatives are present in ratios of approximately 1:1.

7. The composition of claim 1 further characterized in that the azole is at least one triazole present in amounts ranging from about 0.1 to 30 parts by weight.

8. The composition of claim 3 further characterized in that the aminomethylene phosphonic acid is hexamethylenediamine tetra(methylene phosphonic acid).

9. The composition of claim 5 further characterized in that the molybdate is an alkali metal molybdate and the aminomethylene phosphonic acid is hexamethylenediamine tetra (methylene phosphonic acid).

10. The composition of claim 5 further characterized in that the aminomethylene phosphonic acid is a dimer of hexamethylenediamine tetra(methylene phosphonic acid).

11. The composition of claim 5 further characterized in that the aminomethylene phosphonic acid is the derivative of hexamethylenediamine tetra(methylene phosphonic acid) or the derivative of the dimer of hexamethylenediamine tetra(methylene phosphonic acid).

12. The composition of claim 11 further characterized in that the derivative is an alkali metal salt of hexamethylenediamine tetra(methylene phosphonic acid) or the alkali metal salt of the dimer of hexamethylenediamine tetra(methylene phosphonic acid).

13. The composition of claim 5 further characterized as comprising a dispersing amount of at least one water-soluble polymeric dispersing agent.

14. The composition of claim 13 further characterized in that the polymeric dispersing agent is a sulfonated polystyrene.

15. The composition of claim 13 further characterized in that the polymeric dispersing agent is a copolymer of acrylic acid and acrylamide.

16. The composition of claim 13 further characterized in that the polymeric dispersing agent is a combination of sulfonated polystyrene and a copolymer of acrylic acid and acrylamide.

17. The composition of claim 5 further characterized in that the azole is at least one triazole selected from the group consisting of benzotriazole and tolyltriazole.

18. The composition of claim 5 further characterized as comprising a corrosion inhibiting amount of at least one inorganic metal compound selected from the group consisting of nitrates, nitrites, silicates, carbonates and oxides.

19. The composition of claim 18 further characterized in that the inorganic metal compound is an inorganic metal oxide.

20. A process for inhibiting mineral scale and corrosion of metal in the presence of water which comprises adding to the water, parts based on a million parts by weight of water, from about:
   (a) 0 to 50 parts by weight of an azole;
   (b) 1.5 to 100 parts by weight of a molybdate; and
   (c) 2.0 to 100 parts by weight of at least one aminomethylene phosphonic acid or a derivative thereof selected from the group consisting of hexamethylenediamine tetra(methylene phosphonic acid), and the dimer of hexamethylenediamine tetra(methylene phosphonic acid).

21. The process of claim 20 further characterized in that the derivative is an alkali metal salt of hexamethylenediamine tetra(methylene phosphonic acid).

22. The process of claim 20 further characterized in that the derivative is an alkali metal salt of the dimer of hexamethylenediamine tetra(methylene phosphonic acid).

23. The process of claim 20 further characterized in that the aminomethylene phosphonic acid and its derivatives are present in an amount ranging from about 4.0 to 50 parts by weight.

24. The process of claim 23 further characterized in that the molybdate is an alkali metal molybdate present in an amount ranging from about 3.0 to 30 parts by weight.

25. The process of claim 20 further characterized in that the molybdate and the aminomethylene phosphonic acid or its derivatives are present at ratios ranging from about 0.1 to 1.0 part of weight of the molybdate to 1.0 part by weight of the aminomethylene phosphonic acid or its derivatives.

26. The process of claim 25 further characterized in that the azole is at least one triazole selected from the group consisting of benzotriazole and tolyltriazole present in amounts ranging from about 0.1 to 30 parts by weight.

27. The process of claim 25 further characterized in that the molybdate is an alkali metal molybdate and the aminomethylene phosphonic acid is hexamethylenediamine tetra (methylene phosphonic acid).

28. The process of claim 25 further characterized as comprising a corrosion inhibiting amount of at least one inorganic metal compound selected from the group consisting of nitrates, nitrites, silicates, carbonates and oxides.

29. The process of claim 25 further characterized in that a dispersing amount of at least one water-soluble polymeric dispersing agent is added to the water.

30. The process of claim 29 further characterized in that the polymeric dispersing agent is at least one polymer selected from the group consisting of sulfonated polystyrene and copolymers of acrylic acid and acrylamide.

* * * * *